US011352872B2

(12) United States Patent
Manin et al.

(10) Patent No.: US 11,352,872 B2
(45) Date of Patent: Jun. 7, 2022

(54) TEMPERATURE MEASUREMENT CORRECTION IN PRODUCING WELLS

(71) Applicant: SCHLUMBERGER TECHNOLOGY CORPORATION, Sugar Land, TX (US)

(72) Inventors: Yves Manin, Clamart (FR); John R. Lovell, Rosharon, TX (US); George A. Brown, Beaconsfield (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 1055 days.

(21) Appl. No.: 15/762,738

(22) PCT Filed: Sep. 23, 2015

(86) PCT No.: PCT/US2015/051601

§ 371 (c)(1),
(2) Date: Mar. 23, 2018

(87) PCT Pub. No.: WO2017/052523

PCT Pub. Date: Mar. 30, 2017

(65) Prior Publication Data

US 2019/0153854 A1 May 23, 2019

(51) Int. Cl.

| | |
|---|---|
| ***E21B 47/07*** | (2012.01) |
| ***E21B 47/11*** | (2012.01) |
| ***E21B 43/14*** | (2006.01) |

(52) U.S. Cl.

CPC ..... *E21B 47/07* (2020.05); *E21B 43/14* (2013.01); *E21B 47/111* (2020.05); *E21B 2200/20* (2020.05)

(58) Field of Classification Search

CPC ..... E21B 47/07; E21B 47/111; E21B 43/14; E21B 2200/20

(Continued)

(56) References Cited

U.S. PATENT DOCUMENTS

| | | | |
|---|---|---|---|
| 6,776,054 | B1 | 8/2004 | Stephenson et al. |
| 6,920,395 | B2 | 7/2005 | Brown |

(Continued)

FOREIGN PATENT DOCUMENTS

| | | | |
|---|---|---|---|
| WO | 9403802 | A1 | 2/1994 |
| WO | 2001004581 | A1 | 1/2001 |
| WO | 2010097782 | A1 | 9/2010 |

OTHER PUBLICATIONS

International Search Report and Written Opinion issued in the PCT Application PCT/US2015/051601, dated Jun. 15, 2016 (15 pages).

(Continued)

*Primary Examiner* — Justin C Mikowski

(57) ABSTRACT

Methods for correcting temperatures measured in producing wells are provided. In one embodiment, a method includes receiving formation fluid within a completion string in a well, wherein the formation fluid passes from a formation and radially into the completion string through at least one opening in the completion string. The method also includes measuring temperatures outside the completion string at multiple depths in the well at which the formation fluid passes from the formation and radially into the completion string. The temperatures measured outside the completion string at the multiple depths in the well are converted into axial temperatures inside the completion string at the multiple depths. Additional systems, devices, and methods are also disclosed.

20 Claims, 8 Drawing Sheets

(58) Field of Classification Search
USPC ..... 703/10
See application file for complete search history.

(56) References Cited

U.S. PATENT DOCUMENTS

| | | | | |
|---|---|---|---|---|
| 7,778,780 | B2 | 8/2010 | Kimminau et al. | |
| 8,121,790 | B2 | 2/2012 | Kimminau et al. | |
| 8,195,398 | B2 | 6/2012 | Lovell et al. | |
| 2004/0012395 | A1 | 1/2004 | Salamitou | |
| 2005/0149264 | A1 | 7/2005 | Tarvin et al. | |
| 2007/0213963 | A1 | 9/2007 | Jalali et al. | |
| 2008/0201080 | A1 | 8/2008 | Lovell et al. | |
| 2008/0236836 | A1* | 10/2008 | Weng ..... | E21B 47/103 166/336 |
| 2009/0173494 | A1 | 7/2009 | Tarvin et al. | |
| 2010/0082258 | A1 | 4/2010 | Wang | |
| 2010/0163223 | A1 | 7/2010 | Brown | |
| 2011/0100642 | A1 | 5/2011 | Cens et al. | |
| 2013/0144548 | A1 | 6/2013 | Xie | |
| 2014/0365130 | A1 | 12/2014 | Woods | |

OTHER PUBLICATIONS

International Preliminary Report on Patentability issued in the PCT Application PCT/US2015/051601, dated Mar. 27, 2018 (11 pages).

* cited by examiner

TEMPERATURE MEASUREMENT CORRECTION IN PRODUCING WELLS

BACKGROUND

This disclosure relates to monitoring of producing wells, and more particularly to methods and apparatuses for monitoring fluid parameters and flow rates in producing wells.

DESCRIPTION OF THE RELATED ART

Wells are generally drilled into subsurface rocks to access fluids, such as hydrocarbons, stored in subterranean formations. The subterranean fluids can be produced from these wells through known techniques. Various equipment can be used to complete such wells and facilitate production. Further, sensors can be deployed in a well to measure downhole properties of interest, such as temperature and pressure.

Operators may want to know certain characteristics of the well to aid production. For example, operators may want to know flow rates of produced fluids from particular zones in the well. Such flow rate data can be used for numerous purposes, including to identify and diagnose potential flow problems and to determine which flowing zones are producing hydrocarbon fluids. In some instances, temperature data may be collected from the well and used to infer flow information

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

In one embodiment of the present disclosure, a method includes receiving formation fluid passing radially into a completion string through an opening in the completion string. The method also includes measuring temperatures outside the completion string at multiple depths in the well at which the formation fluid passes from the formation and radially into the completion string. These temperatures measured outside the completion string at the multiple depths in the well are then converted into axial temperatures inside the completion string at the multiple depths.

In another embodiment of the present disclosure, a method includes measuring temperatures inside a well at different depths using both temperature sensors positioned in zones of flow of formation fluid into a tubular and impacted by Joule-Thomson effects, and temperature sensors positioned in zones without flow of formation fluid into the tubular, which are not impacted by Joule-Thomson effects. The temperature sensors are radially offset from a central axis of the tubular, and the measured temperatures from the temperature sensors are used to derive a synthetic log of axial fluid temperatures within the tubular at the different depths. The well is then characterized using the derived synthetic log of axial fluid temperatures within the tubular.

In an additional embodiment, an apparatus includes a completion installed in a well and multiple temperature sensors positioned along a tubular of the completion such that the multiple temperature sensors are offset from a central axis of the tubular. The apparatus also includes an analysis system for receiving temperatures measured with the multiple temperature sensors at different well depths along the tubular and for modeling axial temperatures within the tubular at the different well depths. The analysis system can use a correction factor in comparing the temperatures measured along the tubular with the modeled axial temperatures within the tubular to derive a flow profile of the well.

Various refinements of the features noted above may exist in relation to various aspects of the present embodiments. Further features may also be incorporated in these various aspects as well. These refinements and additional features may exist individually or in any combination. For instance, various features discussed below in relation to the illustrated embodiments may be incorporated into any of the above-described aspects of the present disclosure alone or in any combination. Again, the brief summary presented above is intended just to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION

It is to be understood that the present disclosure provides many different embodiments, or examples, for implementing different features of various embodiments. Specific examples of components and arrangements are described below for purposes of explanation and to simplify the present disclosure. These are, of course, merely examples and are not intended to be limiting.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not mandate any particular orientation of the components.

Embodiments of the present disclosure generally relate to analysis of wells that are producing fluids. More particularly, in at least some embodiments, temperature sensors are distributed over a producing interval of a well and measurements from these sensors are used to determine certain characteristics of the well. For instance, a flow profile that indicates flow rates of formation fluid into the well at different depths can be determined using the temperature measurements. Further, in at least one embodiment, the temperature measurements are taken by sensors outside of a completion tubular and determining the flow profile or other characteristics includes correcting these temperature measurements to more accurately reflect axial temperatures within the completion tubular.

Figure 1:
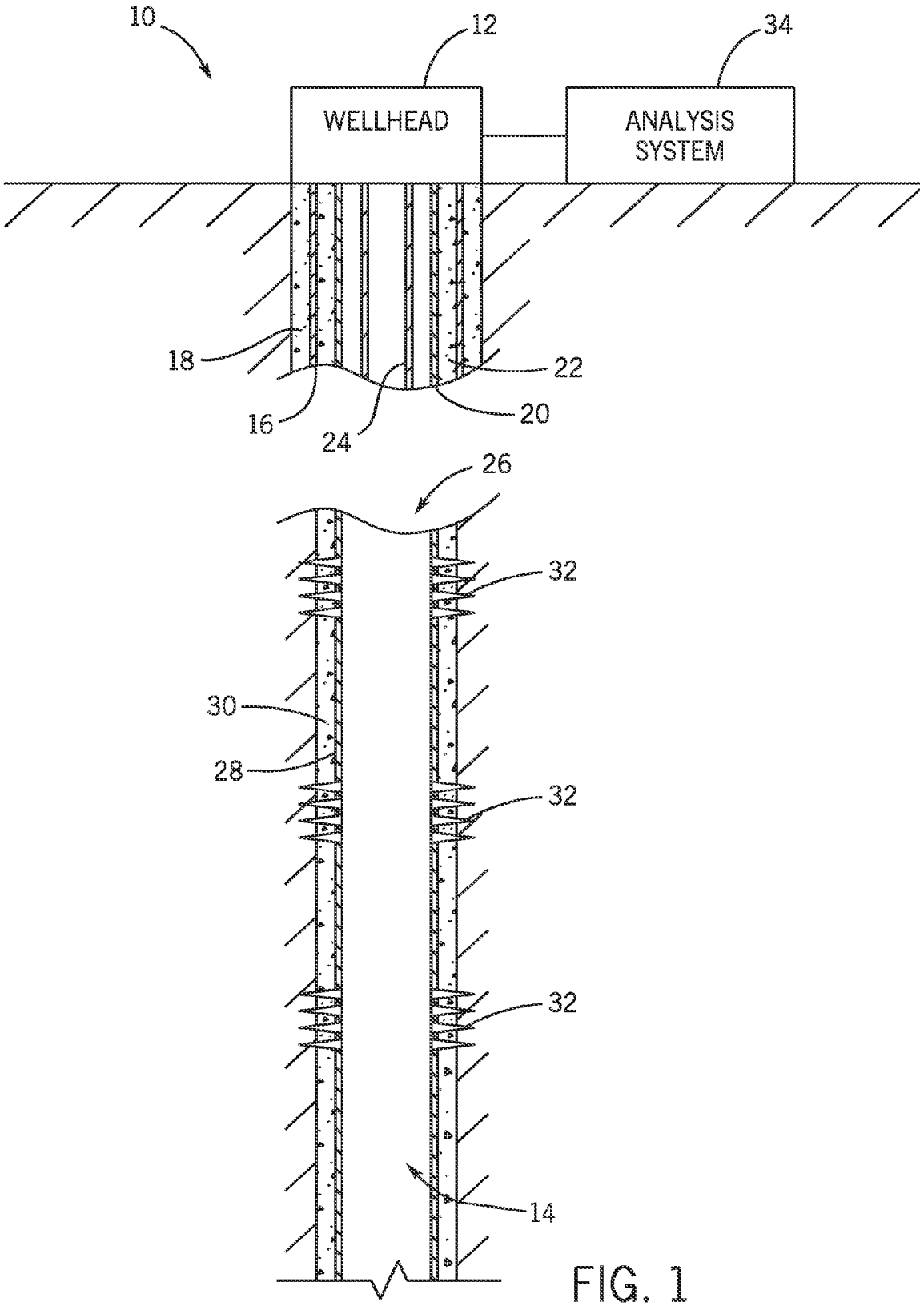
FIG. 1 generally depicts a completed well, through which formation fluid may flow to the surface, and an analysis system for determining flow characteristics of the well in accordance with one embodiment of the present disclosure.

Turning now to the drawings, a production system 10 is generally depicted in FIG. 1 in accordance with one embodiment. While certain elements of the system 10 are depicted in this figure and generally discussed below, it will be appreciated that the system 10 may include other components in addition to, or in place of, those presently illustrated and discussed. The system 10 includes a wellhead 12 mounted over a well 14 extending through subterranean formations. As will be appreciated, wells can include various casing, liners, and other equipment to facilitate production of formation fluids, such as oil and gas. As depicted in FIG. 1 near the wellhead 12, the well 14 includes casing strings 16 and 20 that are cemented in place within the well 14 via cement 18 and 22. Production tubing 24 may be suspended in the well 14 from the wellhead 12 to facilitate production of formation fluids up to the surface.

A lower completion 26 in the well 14 includes a completion string 28 in a producing interval of the well 14. In various embodiments, the completion string 28 is a tubular, such as a casing string extending to the surface or a liner anchored to another casing string. For instance, the completion string 28 could be the casing string 20 itself (e.g., a production casing) or a liner anchored to the casing string 20.

In the presently depicted embodiment, the completion string 28 is cemented in the well 14 with cement 30. The completion string 28 can be perforated in any suitable manner, such as with a jet perforating gun. Formation fluid can flow into the well 14 through the resulting perforations 32 in the completion string 28 and the cement 30. The completion string 28, however, could be provided in other forms. The completion string 28, for instance, can be a slotted liner with a screen provided about the slots and a gravel pack in the annular space between the completion string 28 and the sidewall of the well 14. In at least some embodiments, the producing interval of the well 14 extends through a hydrocarbon reservoir and the well 14 produces hydrocarbon fluids (e.g., oil or gas). But use of the system 10 and the techniques described herein are not limited to use with hydrocarbon fluids or within oilfield contexts.

An analysis system 34 (e.g., a programmed computer system) is also shown in FIG. 1. The analysis system 34 processes data from sensors in the well 14 to facilitate characterization of the well 14. By way of example, pressure and temperature sensors can be provided in the well 14, and the analysis system 34 can process measurements from these sensors to determine various well characteristics (e.g., a flow profile that includes flow rates from a formation into the well at different depths during production). The analysis system 34 can be located at the wellsite, but the analysis system 34 could be provided remote from the wellsite in some embodiments. The analysis system 34 could also be provided as a distributed system in which some components are provided at a wellsite and others are not. For example, data could be collected from downhole sensors by a portion of the analysis system 34 at the wellsite and then communicated to a remote location for processing by another portion of the analysis system 34.

Figure 2:
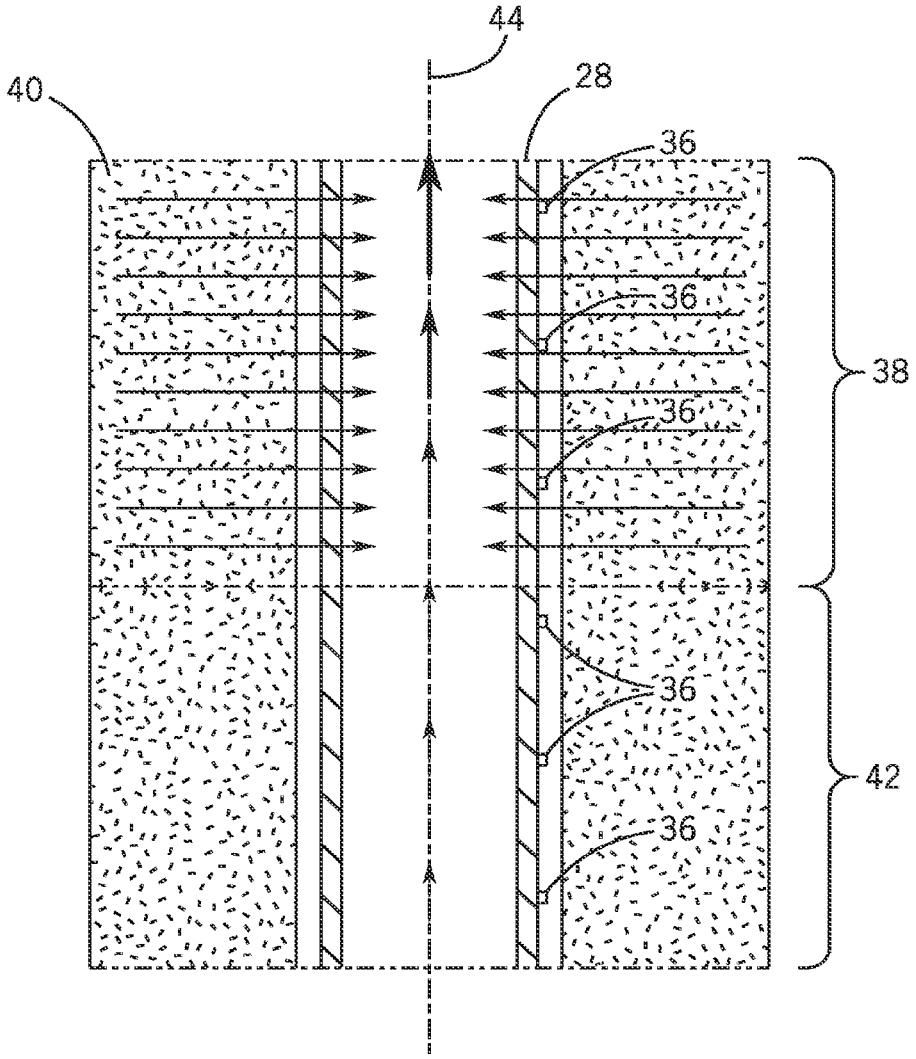
FIG. 2 depicts a portion of the completed well of FIG. 1 that includes a zone of radial flow of formation fluid into a completion string and a zone without radial flow of formation fluid into the completion string in accordance with one embodiment.

In some embodiments, and as generally shown in FIG. 2, sensors 36 can be positioned along the completion string 28 to allow measurements (e.g., temperature or pressure) at different depths in the well 14. In at least one embodiment, the sensors 36 include temperature sensors coupled to the exterior of the completion string 28 (e.g., on the outside of a pipe or screen of the string 28) and are installed across a producing interval of the well 14. These temperature sensors 36 can be spaced apart from one another by any suitable distance. For example, in one embodiment, the temperature sensors 36 are spaced apart in intervals of at least three meters. Still further, the sensors 36 can be provided in any suitable form, such as quartz pressure and temperature gauges, a distributed temperature array with resistive temperature detectors, or fiber-optic temperature sensors. In one embodiment, the sensors 36 could be provided as a fiber-optic distributed temperature system that allows high-density temperature measurements (at one-half meter to one meter spacing) along a producing interval of the well.

The sensors 36 may be positioned across zones in which formation fluid flows into the completion string 28 (e.g., along perforated sections of a liner or casing) and other zones in which fluid does not flow into the completion string 28 (e.g., along sections of a liner or casing without perforations, slots, or other openings in its side wall). As generally depicted in FIG. 2, a portion of the well includes a zone 38 in which fluid from a formation 40 flows radially into the completion string 28 and a zone 42 in which fluid does not flow radially into the completion string 28. The radial flow of formation fluid into the completions string 28 is represented generally by the inwardly directed horizontal arrows in zone 38, but it will be appreciated that the location of radial flow into the completion string 28 will depend on the position of slots, perforations, holes, or other openings in the completion string 28 (and in the cement 30 in the case of a cemented casing or liner).

The temperature of fluid flowing axially through a well string up to the surface can be affected by fluid flowing radially into the well from a formation. Due to this relationship between temperature and fluid flow, interpretation software can use knowledge of downhole temperatures to derive flow characteristics of the well at different depths. In some cases, the flow characteristics are solved as an inverse problem in which the radial flow rates at different depths are parameters of a model that result in a modeled temperature profile along a central axis of axial flow across the different depths, and the radial flow rate parameters are iteratively adjusted to optimize the fit of the resulting modeled temperature profile to the temperatures actually measured in the well.

While such models may provide a modeled profile of temperatures along an axis of flow through a well string, temperature sensors permanently installed in producing wells are not located along this axis. The temperature sensors 36, for example, are installed at the back of the completion string 28 (e.g., on the exterior of the completion string 28), and are thus some radial distance away from its central axis 44. In at least some embodiments of the present technique, the temperatures measured by the sensors 36 outside the completion string 28 at multiple well depths are converted to axial temperatures within the completion string 28 at the same well depths. These converted axial temperatures can include temperatures along the central axis 44 or average temperatures within the bore of the string 28, for example. The converted axial temperatures can then be used by the interpretation software described above to derive a flow profile or other well characteristics of interest.

Figure 3:
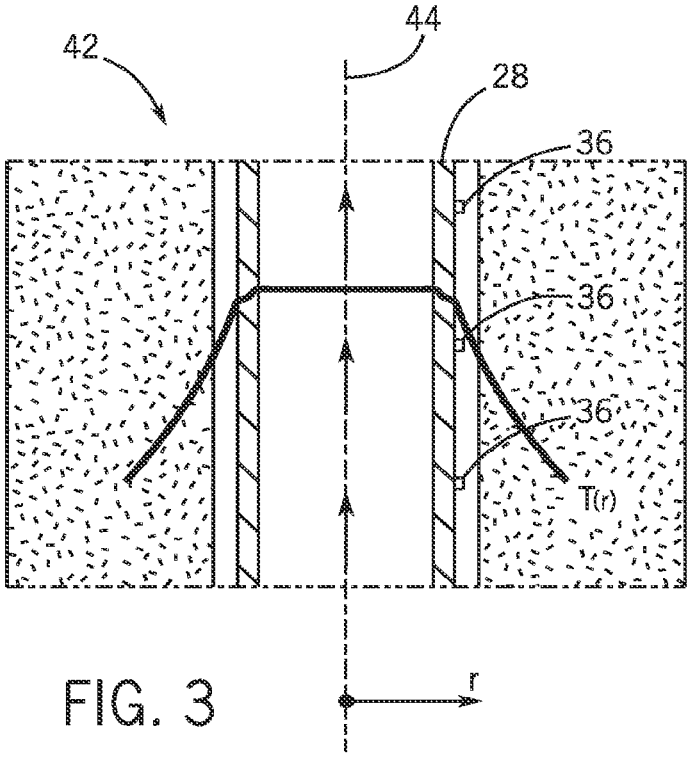
FIG. 3 depicts a cross-sectional temperature profile associated with the zone without radial flow of FIG. 2 in accordance with one embodiment.

The cross-sectional temperature profile at a given depth (i.e., within a plane orthogonal to the central axis 44) depends in part on the extent of nearby radial flow from the formation into the completion string 28. This dependence is generally represented by the plots of temperature (T) as a function of radial distance (r) for the zone 42 without radial flow of a liquid in FIG. 3 and the zone 38 having radial flow of a liquid in FIG. 4. As shown in FIG. 3, the temperature at a given depth within the zone 42 is generally constant across the bore of the completion string 28 and the temperature on the exterior surface of the completion string 28 (which can be measured by a sensor 36) closely approximates that of the interior temperature. Consequently, in such cases the temperature measured by a sensor 36 at some depth in the zone 42 is similar to, and could be taken as, the axial temperature at that depth.

Figure 4:
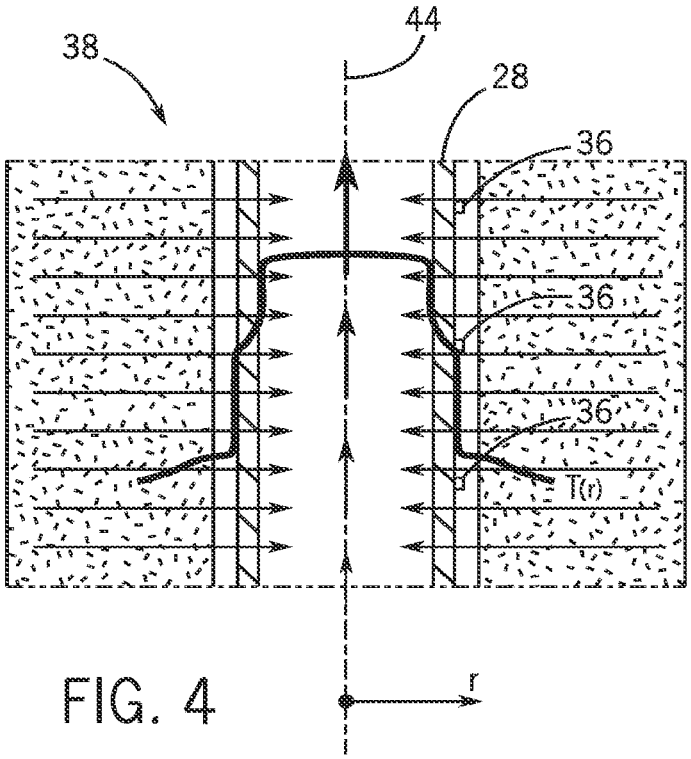
FIG. 4 depicts a cross-sectional temperature profile associated with the zone with radial flow of FIG. 2 in accordance with one embodiment.

As shown in FIG. 4, however, due to radial flow of liquid (e.g., crude oil) into the completion string 28, the temperature measured by a sensor 36 in zone 38 may differ sharply from the axial temperature of the fluid within the string 28. This is because the sensor 36 in the zone 38 is affected not just by the temperature of the fluid traveling axially within the completion string 28 (which transfers heat to the sensor 36 via the wall of the string 28), but also by the temperature of the fluid flowing radially into the completion string 28 from the formation. As a result, the sensor 36 in the zone 38 measures a temperature between the axial wellbore mixture temperature and the entering fluid temperature. It is further noted that fluid enters the wellbore from the formation at the formation temperature plus Joule-Thomson effects due to pressure changes of the fluid as it leaves the formation. In the case of liquids such as crude oil, the Joule-Thomson effect increases the temperature of the fluid flowing radially from the formation into the completion string 28.

The impact of the radial flow on measurements by a sensor 36 depends on the rate of the radial flow. Generally, the higher the permeability of the formation from which the radial flow enters the well, the higher the fluid velocity of the radial flow and the higher the difference between the temperature measured by the sensor 36 and the axial temperature within the completion string 28 at the same depth. This relationship is shown in FIG. 5, which is an example of temperature distributions for an oil well over a range of depths.

Figure 5:
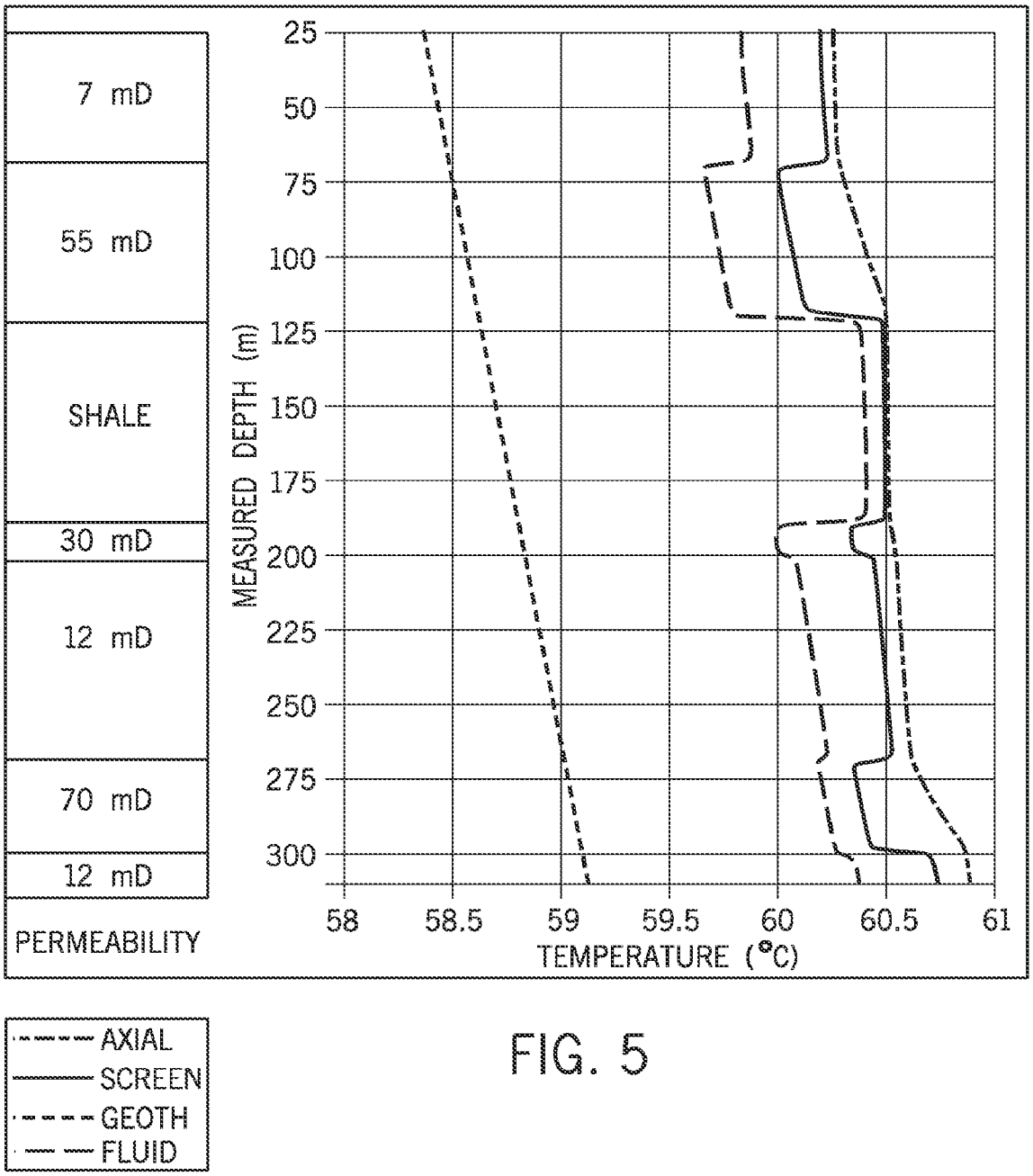
FIG. 5 is a graph depicting temperature distributions for an oil well over a range of depths and shows differences between a temperature measured in a well at the outside of a completion string, the temperature of formation fluid flowing radially into the well, and the temperature of formation fluid flowing axially through the completion string in accordance with one embodiment.

The linear curve on the left in FIG. 5 represents the formation geothermal gradient and generally shows the temperature of the formation increasing linearly with depth. Moving to the right from the formation geothermal gradient curve, the next curve represents the temperature at which formation fluid enters the wellbore (which, as noted above, is generally the formation temperature plus Joule-Thomson effect heating). The rightmost curve in FIG. 5 represents the axial temperature in the well (e.g., along axis 44), while the remaining curve represents the temperature on the exterior of the pipe through which fluid travels up the well and which is measured by the sensors 36. Although labeled as "screen" temperature in FIG. 5, this temperature curve broadly represents the temperature that would be measured on the exterior of a completion string 28 with or without a screen (e.g., in the case of a perforated casing or liner). "Screen temperature" is also used below to generally refer to the temperature measured at the exterior of a completion string 28, and it will be appreciated that this usage also includes temperatures measured at the exterior of a completion string 28 that does not include a screen.

In accordance with certain embodiments, the presently described techniques can be used to automatically derive a synthetic log of axial fluid temperatures within a completion string 28 (e.g., temperatures along the axis 44 or average temperatures in the string 28) from temperature data measured in flowing and non-flowing zones. A synthetic log of the radial fluid temperatures from the formation can also be derived. The synthetic axial temperature log can be used in the interpretation software described above to characterize a well (e.g., by determining a flow profile or other characteristics of the well), and the synthetic radial fluid temperature log provides insight into the drawdown pressure.

The analysis system 34 can derive a measurement of the axial temperature inside the completion string 28 from an external temperature measured outside the completion string 28 by a sensor 36. As described in greater detail below, a correction technique for converting between temperatures measured by sensors 36 at multiple well depths and axial temperatures at the multiple well depths can use a suitable near-wellbore physics model (e.g., radial flow) from the formation into the wellbore and temperature data from sensors 36 clamped and thermally coupled to the completion string 28. In certain embodiments, this correction technique may rely on just four parameters for converting between axial and external temperatures at a given depth in the well: the axial velocity of the fluid in the completion string 28 below the given depth ($V_a$), the temperature of the mixture in the pipe below the given depth ($T_a$), the velocity of the fluid flowing from the formation and radially entering the wellbore at the given depth ($V_r$), and the temperature of the fluid flowing from the formation and radially entering the wellbore at the given depth ($T_r$). But other parameters could also or instead be used in other embodiments.

For known wellbore and completion string sizes, at a given depth the difference between the axial temperature in the completion string and the external temperature measured by a sensor 36 is a function of not just the axial and radial velocities ($V_a$ and $V_r$) and the axial and radial fluid temperatures ($T_a$ and $T_r$), but also various properties of the fluid, such as viscosity ($\mu$), density ($\rho_f$), and thermal properties ($C_p$, k). Using a finite element model, a series of runs was performed in order to study the sensitivity to these individual parameters within ranges that are commonly found in liquid-producing wells. More specifically, a first set of forward runs showed that the sensitivity of the temperature measured at the exterior of the completion string to each of the fluid properties $\mu$, $\rho_f$, $C_p$, and k is quite small for values of those parameters chosen within a typical oil range, such as:

$1\ cP<\mu<5\ cP$ $700\ kg/m^3<\rho_f<1{,}000\ kg/m^3$ $1500\ J/(kg*K)<C_p<2500\ J/(kg*K)$ $0.1\ W/(m*K)<k<0.15\ W/(m*K)$ Given the above, the ratio of the temperature measured at the exterior surface of the completion string 28 ($T_{screen}$) to the axial wellbore temperature within the completion string 28 ($T_{wb}$), which can be considered a correction factor α, can be expressed as a function of just the axial and radial fluid velocities and temperatures:

$$\alpha = \frac{T_{screen}}{T_{wb}} = f(V_a, V_r, T_a, T_r)$$

Several constraints may also be honored, including that: the ratio α should be equal to 1 if the radial and axial temperatures are equal; the ratio α should be 1 if $V_r=0$ (e.g., in a no flow zone); the ratio α should increase with increasing ($T_a-T_r$) values; and the higher $$\frac{V_r}{V_a},$$

the higher the ratio α. With the above constraints in mind, a possible form of the ratio α can be:

$$\alpha = a_1 \times (T_a - T_r)^{a_2} \times \frac{V_r^{a_3}}{V_a^{a_4}} \times \frac{(1 + a_5 V_r T_r)}{(1 + a_6 V_a T_a)} + 1$$

It is noted, however, that the ratio α could be expressed in a different form.

Any suitable analytical technique can be used to derive the coefficients $a_1$ through $a_6$. In one instance, more forward runs of the finite element model were performed with various combinations of the parameters $V_a$, $V_r$, $T_a$, and $T_r$. Then a genetic algorithm was used for the determination of the coefficients ($a_1$, . . . ,$a_6$) using the formulae above calibrated on results of those various runs. In this instance, the optimal fit was obtained for the following values:

$a_1=-3.5992$ $a_2=0.9897$ $a_3=0.6837$ $a_4=-0.1646$ $a_5=-1.6883$ $a_6=0.3339$

Figure 6:
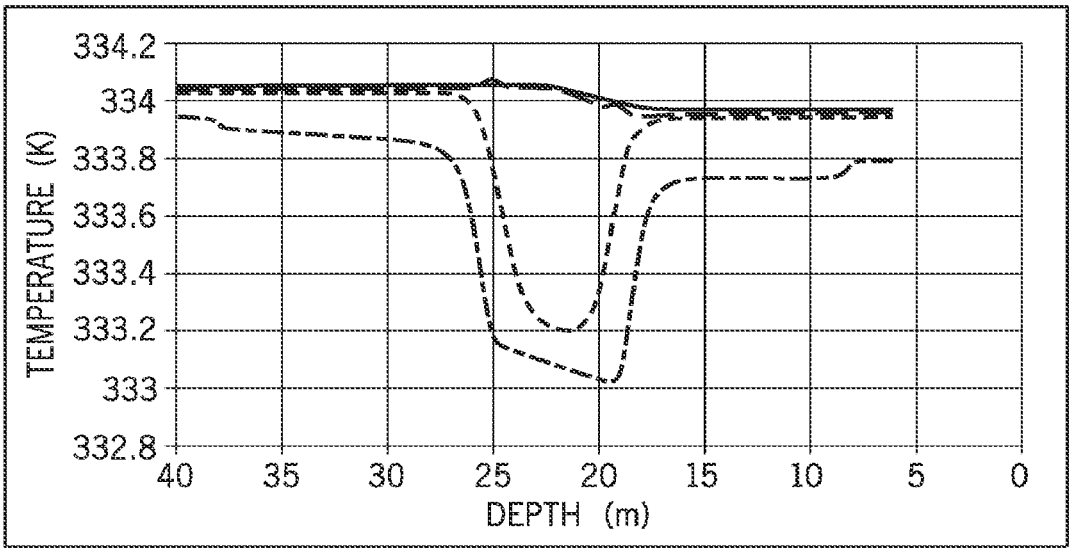
FIGS. 6 and 7 are two examples that demonstrate the effect of temperature correction applied to the temperatures measured in the well on the exterior of a completion string to convert these measured temperatures into axial temperatures within the completion string in accordance with certain embodiments.
Figure 6:
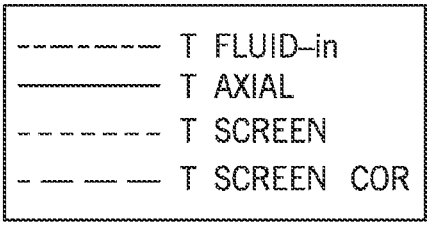
Figure 7:
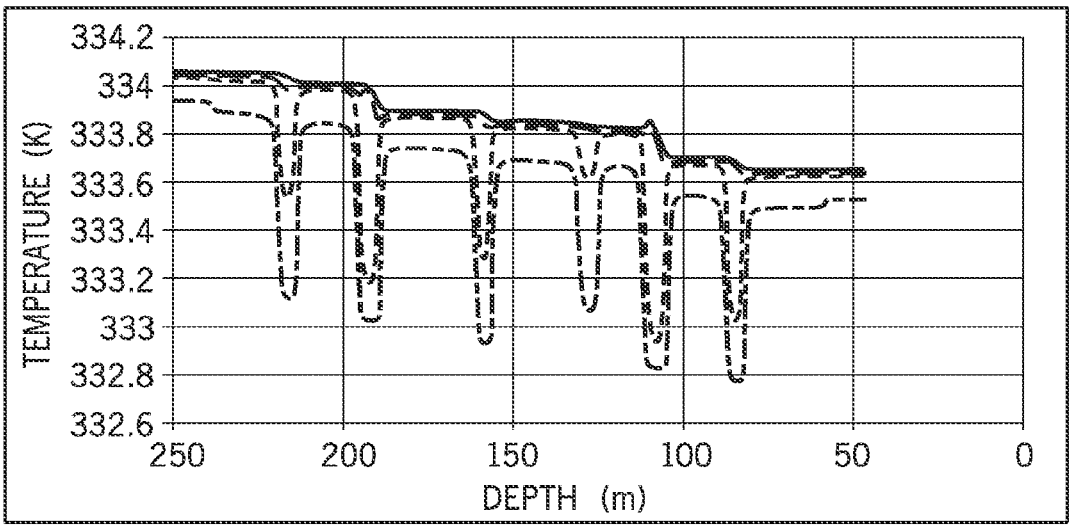
Figure 7:
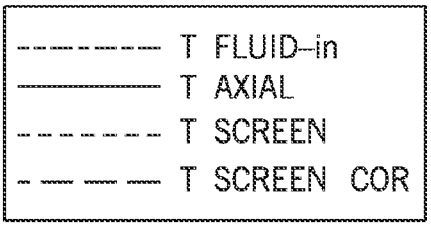

Applying this correction factor α to a series of examples allows the measured (screen) temperature to be converted to axial temperature and used in the interpretation routine described above. The correction is applicable to a range of liquid hydrocarbons, well dimensions, and pipe (e.g., completion string 28) dimensions that cover many typical applications. Should those conditions be outside the current range, however, another correction can be derived using the process described above with a new range of values for those parameters. A comparison between true axial values and the corrected measured value is provided in FIGS. 6 and 7 for two different flow scenarios. In both cases, the effectiveness of the correction is shown, with the measured value (T SCREEN) once corrected (T SCREEN COR) closely approximating the axial temperature (T AXIAL) profile.

The temperature measured by a sensor 36 on the outside of the completion string 28 in a zone 38 of radial flow may also be impacted by the relative locations about the circumference of the completion string 28 of the sensor 36 and an opening through which fluid flows radially into the string 28. For example, in a perforated liner or casing, the perforations may be formed through the pipe wall in a helical pattern. The extent to which the temperature measurement of a sensor 36 is affected by radial flow into the completion string 28 may depend on the azimuth between the sensor 36 and the nearest perforation. Accordingly, in certain embodiments, converting the temperatures measured by the sensors 36 to axial temperatures can also include correcting the measured temperatures to compensate for the azimuths between the sensors 36 and perforations.

Figure 8:
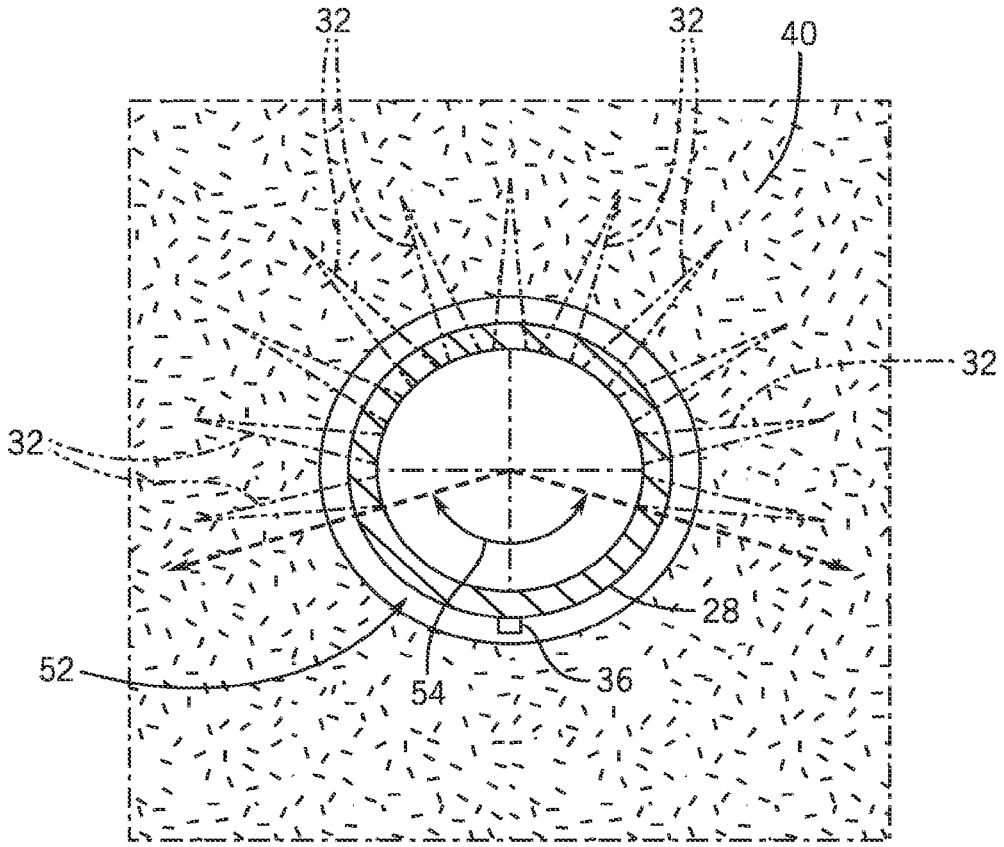
FIG. 8 is an axial cross-section showing a temperature sensor positioned on an unperforated zone of a perforated completion string in accordance with one embodiment.

In one embodiment, this azimuthal compensation is used with a completion string 28 perforated about one portion of its circumference and unperforated about another portion. An example of such a completion string 28 is shown in FIG. 8. The sensors 36 are positioned in an annular space 52 outside the completion string 28 along an unperforated arc of the string 28 with a central angle 54. The central angle 54 of the unperforated arc can be any suitable angle, and in at least some embodiments can be selected to reduce the likelihood of damage to the sensors 36 or associated equipment (e.g., communication cables) from perforation operations. The depicted perforations 32 are shown circumferentially offset from one another in FIG. 8, and it will be appreciated that the perforations 32 are also axially offset (i.e., with perforations 32 at different well depths).

Interpretation software can be used with the synthetic log of corrected axial temperatures to determine certain well characteristics. By way of example, an inversion loop used to derive the flow profile of the well 14 with the corrected axial temperatures is generally represented by the flowchart 60 in FIG. 9. In this embodiment, flow rates 62 for zones of the well 14 (e.g., for each level composing a reservoir section for the well 14) can be provided as input parameters of a layered model 64, which may be based on a multiphase flow model 66 and a heat transfer model 68. Each flow rate 62 corresponds to a set of parameters ($V_a$, $V_r$, $T_a$, $T_r$) from which a correction factor for that zone can be computed, such as by using the technique described above. A forward realization can be performed for each level composing the reservoir section to provide a calculated temperature profile 70 for the well (e.g., modeled axial temperatures in the completion string 28). Measured temperatures 72 (e.g., from the sensors 36 outside the completion string 28) can be corrected (block 74) via correction factors derived from the set of parameters ($V_a$, $V_r$, $T_a$, $T_r$) at the different levels to calculate corrected temperatures 76.

Figure 9:
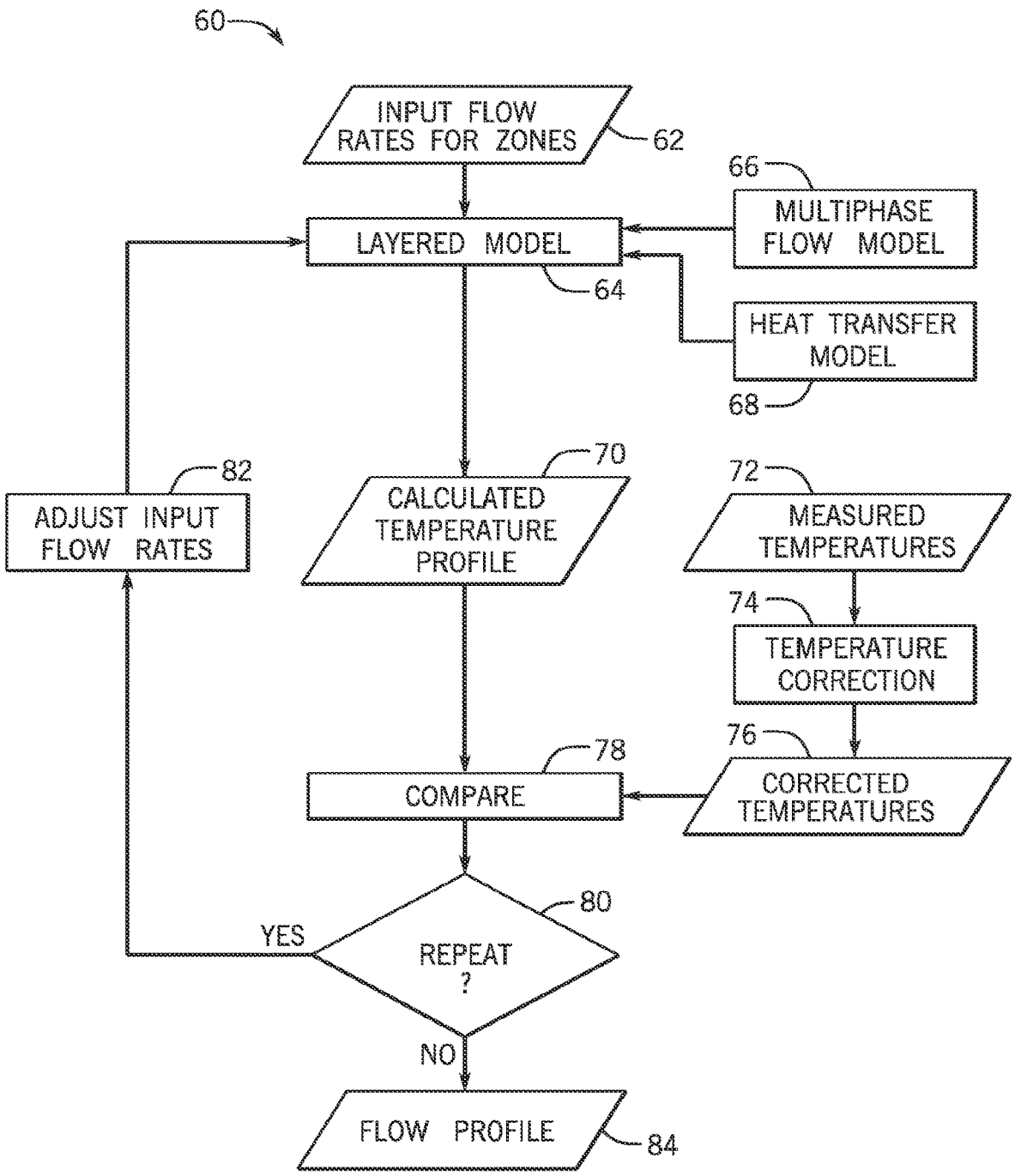
FIG. 9 is a flowchart representing an iterative loop for deriving a flow profile of a well using corrected temperatures in accordance with one embodiment.

The calculated temperature profile 70 can be compared (block 78) to these corrected temperatures 76. As shown in FIG. 9, the flowchart 60 includes an iterative loop for repeating (block 80) the determination and comparison of calculated temperature profiles 70 to the corrected temperatures 76. The input flow rates to the layered model 64 can be adjusted (block 82) with each additional forward run of the model 64 so that the sequence of runs converges toward the solution with the optimal fit of the calculated temperature profile 70 ($T_{cal}$) to the corrected temperatures 76 ($T_{cor}$). The output of the model 64 can be fit to the corrected temperatures in any suitable manner. In some embodiments, the convergence towards the solution that minimizes the value of $\Sigma_1^n(T_{cor}-T_{cal})^2$ can be obtained using, for example, a genetic algorithm technique. This gives the flow profile 84 of the well 14, in that the input flow rates for the solution (i.e., the input flow rates that provide the optimal fit of the calculated temperature profile 70 to the corrected temperatures 76) may be taken as the actual flow rates of formation fluid into the well at the various well depths.

Although FIG. 9 generally shows correction of the measured temperatures 72 and comparison of the corrected temperatures 76 to calculated temperature profiles 70, it will be appreciated that the temperature correction could be applied to the modeled axial temperatures of the calculated temperature profile 70 to convert these modeled axial temperatures into modeled screen temperatures. These modeled screen temperatures could then be compared to the measured temperatures 72 in an iterative manner like that described above to determine the flow profile of the well 14.

An analysis system 34 of the system 10 can be used to implement the functionality described above. For example, in at least some embodiments the analysis system 34 is operable to receive temperatures measured with sensors 36 at different depths in a well along a tubular of the completion string 28, to model temperatures along a central axis within the tubular at the different depths, and to use a correction factor in comparing the temperatures measured along the tubular with the modeled temperatures along the central axis to derive a flow profile or other characteristics of interest for the well. In one embodiment, the analysis system applies the correction factor to convert the temperatures measured by sensors 36 outside the tubular into corrected temperatures along the central axis of the tubular (e.g., by dividing the temperature measured by sensor 36 at each depth by the correction factor $\alpha$ for that depth). The analysis system can then derive a flow profile for the well by iteratively varying input flow parameters of a model to fit modeled axial temperatures to the corrected axial temperatures within a tubular in the well to determine flow rates of formation fluid into the well at various well depths.

Figure 10:
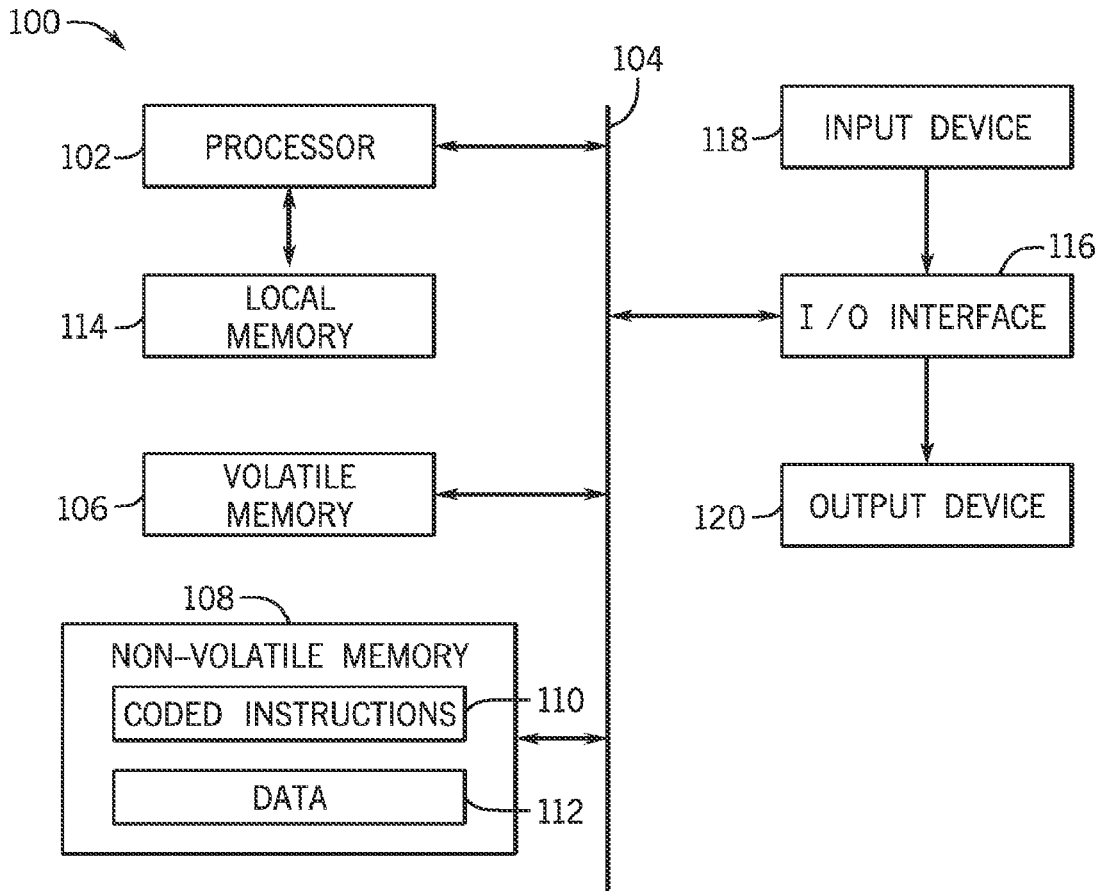
FIG. 10 is a block diagram of components of one example of the analysis system of FIG. 1 that can be used to determine a flow profile of a well in accordance with one embodiment.

The analysis system 34 can be provided in any suitable form, such as a processor-based system. An example of such a processor-based system 100 is generally provided in FIG. 10. In this depicted embodiment, the system 100 includes at least one processor 102 connected by a bus 104 to volatile memory 106 (e.g., random-access memory) and non-volatile memory 108 (e.g., flash memory and a read-only memory (ROM)). Coded application instructions 110 (e.g., models 64, 66, and 68) and data 112 (e.g., model parameters and measured temperatures) are stored in the non-volatile memory 108. The instructions 110 and the data 112 may be also be loaded into the volatile memory 106 (or in a local memory 114 of the processor) as desired, such as to reduce latency and increase operating efficiency of the system 100. The coded application instructions 110 can be provided as software that may be executed by the processor 102 to enable various functionalities described above. In at least some embodiments, the application instructions 110 are encoded in a non-transitory, computer-readable storage medium, such as the volatile memory 106, the non-volatile memory 108, the local memory 114, or a portable storage device (e.g., a flash drive or a compact disc).

An interface 116 of the system 100 enables communication between the processor 102 and various input devices 118 and output devices 120. The interface 116 can include any suitable device that enables such communication, such as a modem or a serial port. In some embodiments, the input devices 118 include one or more sensing components of the system 10 (e.g., sensors 36) and the output devices 120 include displays, printers, and storage devices that allow output of data received or generated by the system 100.

The foregoing outlines features of several embodiments so that those skilled in the art may better understand aspects of the present disclosure. Those skilled in the art should appreciate that they may readily use the present disclosure as a basis for designing or modifying other processes and structures for carrying out the same purposes or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

Although the preceding description has been described herein with reference to particular means, materials and embodiments, it is not intended to be limited to the particulars disclosed herein; rather, it extends to all functionally equivalent structures, methods, and uses, such as are within the scope of the appended claims.

The invention claimed is:

1. A method comprising:

receiving formation fluid within a completion string in a well, wherein the formation fluid passes from a formation and radially into the completion string through at least one opening in the completion string;

measuring temperatures outside the completion string at multiple depths in the well at which the formation fluid passes from the formation and radially into the completion string; and converting the temperatures measured outside the completion string at the multiple depths in the well into axial temperatures inside the completion string at the multiple depths by dividing the temperatures measured outside the completion string by correction factors for the multiple depths.

2. The method of claim 1, further comprising:

determining a flow profile of the well using the axial temperatures inside the completion string converted from the temperatures measured outside the completion string.

3. The method of claim 1, wherein converting the temperatures measured outside the completion string at the multiple depths into axial temperatures inside the completion string includes using a ratio relating the axial temperatures to the measured temperatures outside the completion string to correct the measured temperatures.

4. The method of claim 3, further comprising:

defining the ratio as a function of velocity and temperature of the formation fluid passing from the formation and radially into the completion string at the given depth and of velocity and temperature of formation fluid passing axially through the completion string.

5. The method of claim 1, wherein measuring temperatures outside the completion string at multiple depths in the well includes using sensors installed on an exterior of the completion string to measure the temperatures outside the completion string.

6. The method of claim 1, wherein receiving formation fluid within the completion string in the well includes receiving oil within the completion string.

7. The method of claim 1, further comprising:

measuring temperatures outside the completion string at additional multiple depths in the well at which the formation fluid does not pass from the formation and radially into the completion string.

8. The method of claim 1, wherein receiving formation fluid within the completion string in the well includes receiving oil within the completion string through perforations in the completion string.

9. The method of claim 8, wherein converting the temperatures measured outside the completion string into axial temperatures inside the completion string at the multiple depths includes compensating for the impact of variations in azimuths between the perforations and sensors installed outside the completion string on temperatures measured outside the completion string by the sensors at different depths of the multiple depths.

10. A method comprising:

measuring temperatures inside a well at different depths using:

a first plurality of temperature sensors positioned in zones of flow of formation fluid into a tubular and that are impacted by Joule-Thomson effects; and a second plurality of temperature sensors positioned in zones without flow of formation fluid into the tubular and that are not impacted by Joule-Thomson effects, wherein the first and second pluralities of temperature sensors are radially offset from a central axis of the tubular;

using the measured temperatures from the first and second pluralities of temperature sensors to derive a synthetic log of axial fluid temperatures within the tubular at the different depths by dividing the measured temperatures by correction factors for the different depths; and characterizing the well using the derived synthetic log of axial fluid temperatures within the tubular.

11. The method of claim 10, wherein measuring temperatures inside the well at different depths includes measuring the temperatures inside the well at different depths using the first plurality of temperature sensors positioned in zones of flow of formation fluid into the tubular and that are impacted by Joule-Thomson heating effects.

12. The method of claim 10, wherein characterizing the well using the derived synthetic log of axial fluid temperatures within the tubular includes determining a flow profile of the well.

13. The method of claim 10, wherein measuring temperatures inside the well at different depths includes measuring the temperatures inside the well at different depths using: the first plurality of temperature sensors positioned in zones of flow of formation fluid into a casing or a liner, and the second plurality of temperature sensors positioned in zones without flow of formation fluid into the casing or the liner.

14. An apparatus comprising:

a completion installed in a well;

multiple temperature sensors positioned along a tubular of the completion such that the multiple temperature sensors are offset from a central axis of the tubular; and an analysis system operable to receive temperatures measured with the multiple temperature sensors at different well depths along the tubular, to model axial temperatures within the tubular at the different well depths, and to use a correction factor in comparing the temperatures measured along the tubular with the modeled axial temperatures within the tubular to derive a flow profile of the well, the analysis system operable to apply a correction factor to convert the temperatures measured at different well depths along the tubular into corrected axial temperatures within the tubular at the different well depths by dividing the temperature measured at each well depth by a correction factor for that depth.

15. The apparatus of claim 14, wherein the multiple temperature sensors are coupled to an exterior of the tubular.

16. The apparatus of claim 14, wherein the multiple temperature sensors are positioned across a producing interval of the well at intervals of at least three meters.

17. The apparatus of claim 14, wherein the analysis system is operable to:

vary input flow parameters of a model to fit the modeled axial temperatures within the tubular to the corrected axial temperatures within the tubular to determine flow rates of formation fluid into the well at various well depths.

18. The apparatus of claim 14, wherein the tubular of the completion includes a liner or a casing.

19. The apparatus of claim 14, wherein the tubular of the completion is cemented in place within the well.

20. The apparatus of claim 14, wherein the analysis system is positioned at the wellsite.

* * * * *